US008627961B2

(12) United States Patent
Molteni

(10) Patent No.: US 8,627,961 B2
(45) Date of Patent: Jan. 14, 2014

(54) EDDY CURRENT SEPARATOR

(75) Inventor: Danilo Domenico Molteni, Manerbio (IT)

(73) Assignee: SGM Magnetics Corp., Sarasota, FL (US)

( * ) Notice: Subject to any disclaimer, the term of this patent is extended or adjusted under 35 U.S.C. 154(b) by 0 days.

(21) Appl. No.: 13/526,174

(22) Filed: Jun. 18, 2012

(65) Prior Publication Data

US 2012/0248013 A1 Oct. 4, 2012

Related U.S. Application Data

(63) Continuation of application No. 12/643,748, filed on Dec. 21, 2009, now Pat. No. 8,201,694.

(51) Int. Cl.
*B03C 1/22* (2006.01)

(52) U.S. Cl.
USPC ..... 209/636

(58) Field of Classification Search
USPC ..... 209/7, 219, 223.2, 362.2, 636
See application file for complete search history.

(56) References Cited

U.S. PATENT DOCUMENTS

| | | | | |
|---|---|---|---|---|
| 4,106,627 | A * | 8/1978 | Watanabe et al. | 209/7 |
| 4,137,156 | A * | 1/1979 | Morey et al. | 209/212 |
| 5,057,210 | A * | 10/1991 | Julius | 209/212 |
| 5,064,075 | A * | 11/1991 | Reid | 209/636 |
| 5,626,233 | A | 5/1997 | Wells | |
| 5,655,664 | A * | 8/1997 | Barrett | 209/212 |
| 5,860,532 | A * | 1/1999 | Arvidson | 209/212 |
| 7,743,926 | B2 * | 6/2010 | Lewis-Gray | 209/223.2 |
| 8,201,694 | B2 | 6/2012 | Molteni | |
| 2012/0248013 | A1 * | 10/2012 | Molteni | 209/629 |

FOREIGN PATENT DOCUMENTS

| | | |
|---|---|---|
| EP | 2128279 | 12/2009 |
| WO | WO 98/19795 | 5/1998 |
| WO | WO 00/40336 | 7/2000 |
| WO | WO 2009/145615 | 12/2009 |

OTHER PUBLICATIONS

International Search Report for PCT/EP2010/070291 mailed Mar. 15, 2011.

* cited by examiner

*Primary Examiner* — Terrell Matthews
(74) *Attorney, Agent, or Firm* — King & Spalding

(57) ABSTRACT

An eddy current separator ("ECS") separates electroconductive and non-electroconductive materials. The materials can include "fines" having diameters less than about 10 millimeters. The ECS includes first and second hubs coupled to opposite ends of a magnet support tube. Magnets are coupled to the magnet support tube, substantially between the hubs. A motor coupled to one or both of the hubs rotates the magnet support tube and magnets to generate an eddy current in electroconductive material conveyed proximate the separator. The material in which the eddy current is created is repelled and projected away from the ECS along a predictable trajectory. An eddy current is not generated in nonconductive material conveyed proximate the separator. Therefore, that material is not projected away. A jacket tube may house the magnets and contain centrifugal forces of the magnets during rotation thereof That tube may comprise a Ti60 titanium alloy or other material.

20 Claims, 4 Drawing Sheets

EDDY CURRENT SEPARATOR

This application is a continuation of U.S. application Ser. No. 12/643,748 filed Dec. 21, 2009, now U.S. Pat. No. 8,201,694 the contents of which are hereby incorporated by reference.

TECHNICAL FIELD

The present disclosure relates generally to an eddy current separator and, more particularly, to an eddy current separator that operates at a very high frequency.

BACKGROUND

An eddy current separator ("ECS") is a device that separates electroconductive materials from non-electroconductive materials. A conventional ECS typically includes at least two pulleys over which a conveyor belt runs. Material to be processed is fed onto the conveyor belt, which moves the material across a magnetic rotor of the ECS.

The magnetic rotor includes a pulley on which a series of axial rows of permanent magnet blocks are mounted. Each row includes magnet blocks that have the same polar orientation. The polar orientation alternates from row to row. The pulley is mounted on a shaft.

The magnetic rotor is enclosed in (but not attached to) a non-metallic shell which supports the conveyor belt. This allows the magnetic rotor to spin independently and at a much higher rate of speed than the non-metallic shell and the conveyor belt. The faster rotation of the alternate axial polarity rows relative to the speed of the conveyor belt makes the material conveyed to the magnetic rotor by the conveyor belt cross a variable magnetic field that creates a circulating electrical current or "eddy current" in any electroconductive elements in the material.

The eddy current produces a magnetic field that has a polarity that is the same as the polarity of the magnet(s) that induced the eddy current. Since like magnetic poles repel on another, the material in which the eddy current is created is repelled and projected away from the conveyor belt along a predictable trajectory. The projected material is collected in a first receptacle disposed at the end of the trajectory. The non-electroconductive material falls from the end of the conveyor belt into a second receptacle. Thus, the magnetic rotor separates the electroconductive and non-electroconductive materials into the first and second receptacles, respectively.

ECS's are used in many different industrial and non-industrial applications. For example, an ECS may be used to separate and recover like materials in a waste stream. Recycling of waste materials is highly desirable from many viewpoints, not the least of which are financial and ecological. Properly sorted recyclable materials can often be sold for significant revenue. Many of the more valuable recyclable materials do not biodegrade within a short period. Recycling of those materials significantly reduces the strain on local landfills and, ultimately, the environment.

Typically, waste streams are composed of a variety of types of waste materials. One such waste stream is generated from the recovery and recycling of automobiles or other large machinery and appliances. For example, at the end of its useful life, an automobile is shredded. The shredded material is processed to recover ferrous and non-ferrous metals. The remaining materials that are not recovered are referred to as automobile shredder residue ("ASR"). The ASR, which may still include ferrous and non-ferrous metals, including copper wire and other recyclable materials, is typically disposed of in a landfill.

Recently, efforts have been made to further recover materials, such as plastics and copper and other non-ferrous metals, from ASR. Similar efforts have been made to recover materials from whitegood shredder residue (WSR), which includes the waste materials left over after recovering ferrous metals from shredded machinery or large appliances. Other waste streams that have recoverable materials include electronic components (also known as "e-waste" or "waste electrical and electronic equipment" ("WEEE")), building components, retrieved landfill material, municipal waste, either incinerated or not, and other industrial waste streams.

Many materials processed using ECS devices, including typical waste streams, include a variety of different electroconductive and non-electroconductive materials having diameters less than about 10 mm. For simplicity, such materials are referred to herein as "fines." The ability of an ECS to separate fines effectively depends on the frequency of the ECS. Generally, the higher the frequency, the greater the ability of the ECS to separate fines effectively.

Increasing the frequency of a conventional ECS is problematic because the increased speed of the magnetic rotor can cause mechanical stresses on the ECS. For example, the mechanical holding force of the magnetic rotor of the ECS can be challenged by stronger centrifugal forces resulting from the higher speed of the magnetic rotor. In addition, the shaft of the magnetic rotor generally reaches its own natural frequency at about 5,400 rotations per minute. To ensure that the shaft stays sufficiently below its own natural frequency and to prevent the shaft from having resonance and harmonic problems that the ECS would not be able to withstand, a speed limit of approximately 3,000 rotations per minute for an ECS up to 1.5 meters wide to 4,000 rotations per minute for an ECS up to one meter wide generally has been imposed.

Therefore, a need exists for an ECS that can effectively separate fines. In particular, a need exists for an ECS that can durably operate at a high frequency.

SUMMARY

An ECS that durably operates at a high frequency is described herein. The ECS separates electroconductive and non-electroconductive materials. The materials can have a variety of different sizes and shapes, including fines having diameters less than about 10 millimeters.

The ECS includes first and second hubs coupled to opposite ends of a magnet support tube. Magnets are coupled to the magnet support tube, substantially between the hubs. The magnets may include a series of axial rows of permanent magnet blocks that are mounted to the magnet support tube. Polar orientation may alternate from row to row, substantially as is known in the art.

A motor coupled to one or both of the hubs rotates the magnet support tube and magnets to generate an eddy current in electroconductive material conveyed proximate the separator. For example, the electroconductive material and non-electroconductive materials can travel along a conveyor that runs over and/or around the separator. The electroconductive material in which the eddy current is created is repelled and projected away from the ECS along a predictable trajectory. For example, the projected material may travel from the ECS into a first receptacle. An eddy current is not generated in the nonconductive material. Therefore, that material rolls off the conveyor without being projected away. For example, that material may roll into a second receptacle. Therefore, the electroconductive material and nonelectroconductive material are separated into different receptacles.

Because the ECS includes two hubs and not a single motor shaft, as is typically included in a conventional ECS, conventional frequency limits based on a shaft natural frequency of 5,400 rotations per minute are not applicable in the ECS. Instead, a higher natural frequency of the magnet support tube of the ECS—approximately 28,000 rotations per minute—is the basis for determining the maximum operation speed of the ECS. Thus, the ECS can operate at significantly higher speeds than conventional ECS devices. For example, in certain exemplary embodiments, the ECS can operate durably and effectively at frequencies of 6,000 rotations per minute for an ECS up to one meter wide and 4,000 rotations per minute for an ECS up to 1.5 meters wide.

In addition, the ECS may operate at the same or similar operating speeds as conventional ECS devices but with higher widths than the conventional ECS devices. For example, the ECS may operate at 4,000 rotations per minute with a width of 1.5 meters or 3,000 rotations per minute with a width of 2.5-3.0 meters, as compared to widths of 1 meter and 2 meters for conventional devices operating at 4,000 rotations per minute and 3,000 rotations per minute, respectively.

The magnet blocks may be jacketed in a tube that contains centrifugal forces of the magnet blocks during rotation thereof The centrifugal force that the magnet blocks accumulate generates a significant amount of pressure on the tube. The pressure is contained by reaction efforts of the tube, which may be fitted with a negative allowance to maintain the device within a yield limit of the material of the tube. The tube may comprise any material, such as a Ti60 titanium alloy, that is suited for containing high pressure associated with high speed operation of the device.

These and other aspects, objects, features, and embodiments will become apparent to a person of ordinary skill in the art upon consideration of the following detailed description of illustrative embodiments exemplifying the best mode for carrying out the invention as presently perceived.

BRIEF DESCRIPTION OF THE DRAWINGS

For a more complete understanding of the invention and the advantages thereof, reference is now made to the following description, in conjunction with the accompanying figures briefly described as follows.

DETAILED DESCRIPTION OF THE EXEMPLARY EMBODIMENTS

Turning now to the drawings, in which like numerals indicate like elements throughout the figures, exemplary embodiments of the invention are described in detail.

Figure 1:
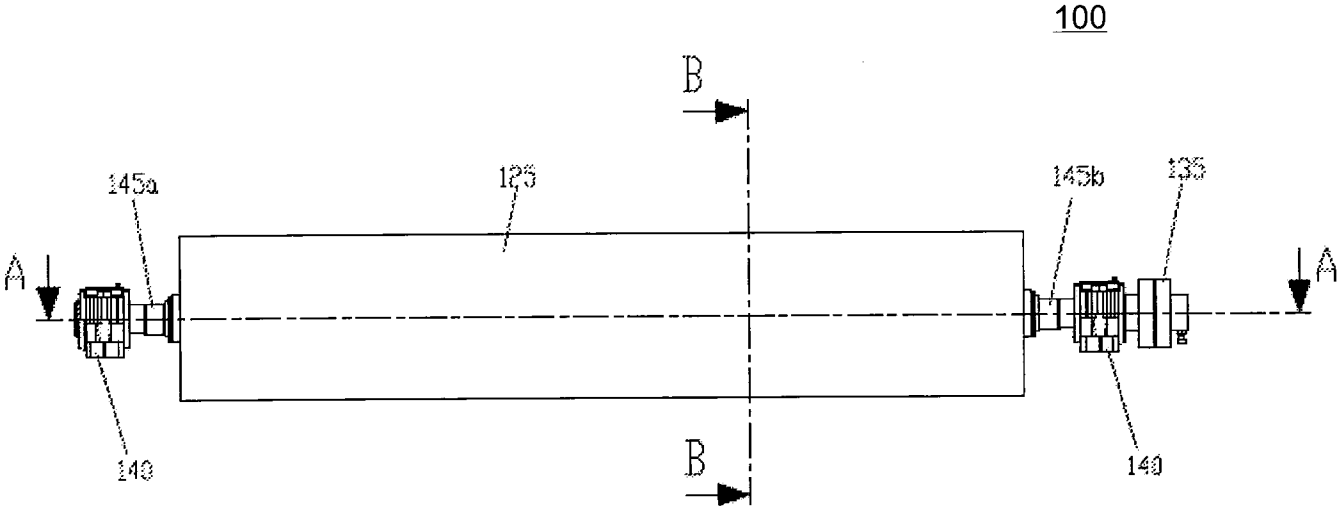
FIG. 1 is an elevational side view of an ECS, in accordance with certain exemplary embodiments.
Figure 2:
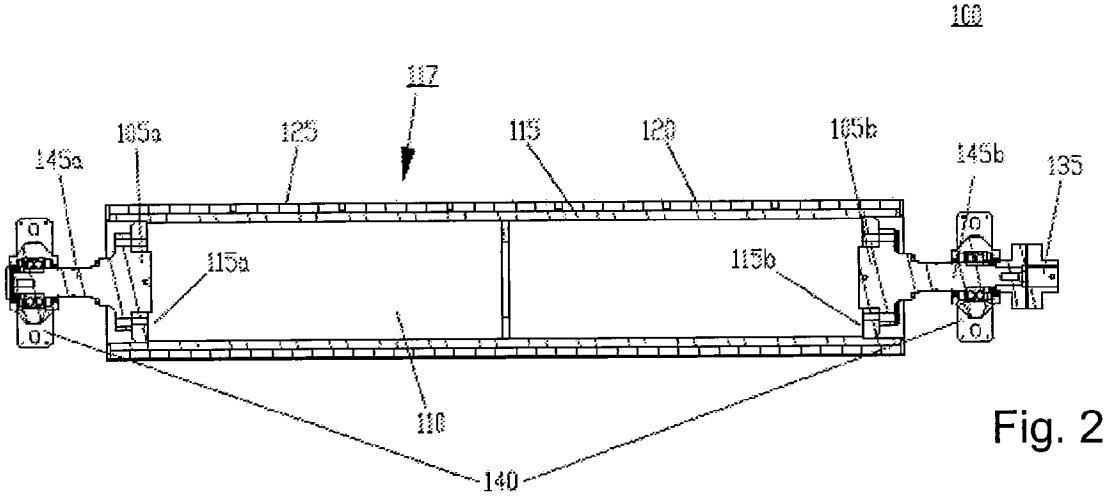
FIG. 2 is a cross-sectional side view of the ECS of FIG. 1, in accordance with certain exemplary embodiments.
Figure 3:
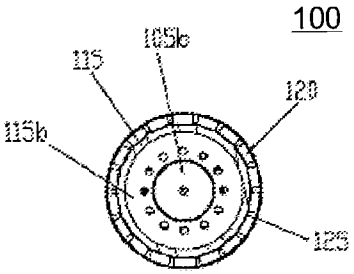
FIG. 3 is a cross-sectional side view of the ECS of FIG. 1, in accordance with certain exemplary embodiments.

FIG. 1 is an elevational side view of an ECS 100, in accordance with certain exemplary embodiments. FIG. 2 is a side view of a cross-section A-A of the ECS 100, in accordance with certain exemplary embodiments. FIG. 3 is a side view of a cross-section B-B of the ECS 100, in accordance with certain exemplary embodiments. With reference to FIGS. 1-3, the ECS 100 includes a rotating assembly 117 that includes a pulley 110. The pulley 110 includes a magnet support tube 115 on which magnet blocks 120 are coupled. The magnet support tube 115 can comprise any material, such as a mild iron or another material. In certain exemplary embodiments, the magnet blocks 120 are arranged in a series of axial rows, with magnet blocks 120 in the same row having the same polar orientation and adjacent rows having opposite polar orientations. Thus, the polar orientation alternates from row to row.

The magnet support tube 115 is coupled to a motor 135 via a hub 105*b*. The hub 105*b* is coupled to an end 115*b* of the magnet support tube 115 as well as to an operating shaft 145*b*, which is in turn coupled to the motor 135. Rotation of the operating shaft 145 by the motor 135 causes rotation of the magnet support tube 115 and the magnet blocks 120 coupled thereto. As described below, rotation of the magnet blocks 120 creates a variable magnetic field that generates an eddy current, which may be induced in electroconductive materials 220 (FIG. 4) traveling on a conveyor belt 210 (FIG. 4) associated with the ECS 100.

Another hub 105*a* is coupled to an opposite end 115*a* of the magnet support tube 115 as well as to another operating shaft 145*a*. Each hub 105 is coupled to a respective end of the magnet support tube 115. Each hub 105 can be coupled to its respective end by any of a variety of means, including solder, braze, welds, glue, epoxy, rivets, clamps, screws, nails, or other fastening means known to a person of ordinary skill in the art having the benefit of the present disclosure. For example, each hub 105 may be spliced to the magnet support tube 115. High speed bearing supports 140 provide mechanical support for each operating shaft 145 and, in turn, the magnet support tube 115. In certain alternative exemplary embodiments, each operating shaft 145 is integral to its corresponding hub 105.

In certain exemplary embodiments, the magnet support tube 115 has a natural frequency of approximately 28,000 rotations per minute. Because the ECS 100 includes two hubs 105 and not a single motor shaft, as is typically included in a conventional ECS, conventional frequency limits based on a shaft natural frequency of 5,400 rotations per minute are not applicable in the ECS 100. Instead, the higher natural frequency of the magnet support tube 115 of the ECS 100—approximately 28,000 rotations per minute—is the basis for determining the maximum operation speed of the ECS 100. Thus, the ECS 100 can operate at significantly higher speeds than conventional ECS devices. For example, in certain exemplary embodiments, the ECS 100 can operate durably and effectively at frequencies of 6,000 rotations per minute for an ECS 100 up to one meter wide and 4,000 rotations per minute for an ECS 100 up to 1.5 meters wide.

In addition, the ECS 100 may operate at the same or similar operating speeds as conventional ECS devices but with higher widths than the conventional ECS devices. For example, the ECS 100 may operate at 4,000 rotations per minute with a width of 1.5 meters or 3,000 rotations per minute with a width of 2.5-3.0 meters, as compared to widths of 1 meter and 2 meters for conventional devices operating at 4,000 rotations per minute and 3,000 rotations per minute, respectively.

The magnet blocks 120 are jacketed in a tube 125 that contains centrifugal forces of the magnet blocks 120 during rotation thereof. The centrifugal force that the magnet blocks 120 accumulate at 4,000 rotations per minute generates a pressure of about 1.7 Mpa on the tube 125. The pressure is contained by reaction efforts of the tube 125, which is fitted with a negative allowance to maintain the assembly 117 within a yield limit of the material of the tube 125.

A higher speed of the assembly 117 corresponds to a higher amount of pressure to be contained by the tube 125. For example, a speed of about 6,000 rotations per minute generally corresponds to a pressure of about 4.65 Mpa, as compared to 1.7 Mpa when the speed is 4,000 rotations per minute. Although the tube 125 can comprise any non-magnetic material, it has been found that a titanium alloy, such as Ti60, is particularly well suited for containing high pressure associated with high speed operation of the assembly 117. Ti60 generally has a yield value that is double the yield value of AISI 304 and 316 stainless steel that is commonly used in conventional ECS devices.

To achieve the same containment properties of a tube 125 comprising Ti60, one would have to significantly increase the thickness of a tube 125 comprising AISI 304 or 316. For example, one might have to double the thickness of a tube 125 comprising AISI 304 or 316 from 2 millimeters to 4 millimeters to achieve the same pressure containment ability of a tube 125 comprising Ti60. Increasing the thickness of the tube 125 generally is undesirable because the increased thickness would significantly reduce the magnetic working effects of the magnet blocks 120, thereby making the ECS 100 less effective. Using Ti60 provides an increased, pre-determined negative allowance that enables containment of the high pressure generated by the centrifugal force of the magnet blocks 120 without negatively impacting the magnetic properties of the ECS 100 or the level of throwing energy required for separation and recovery of the electroconductive and non-electroconductive materials.

Figure 4:
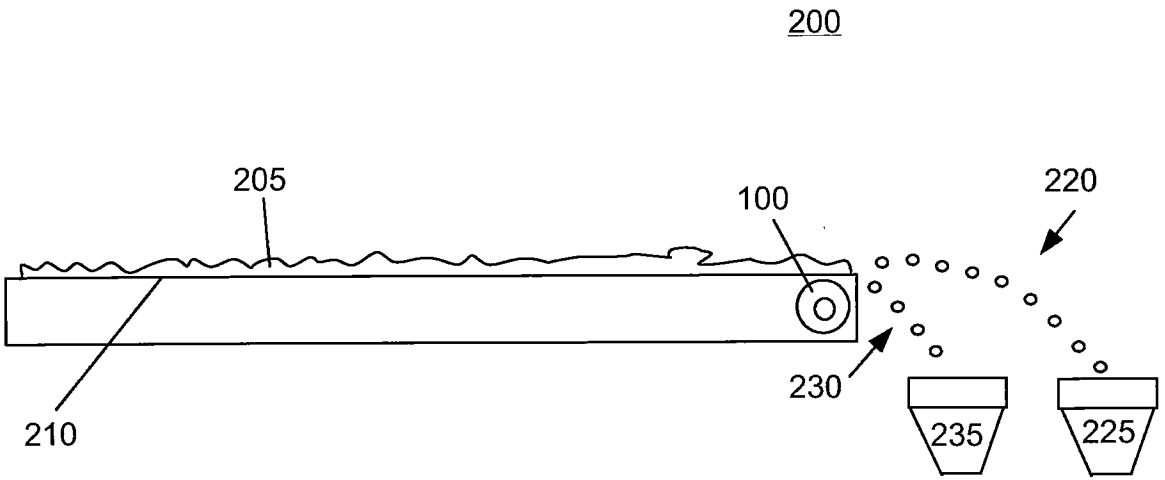
FIG. 4 is a block diagram that depicts an elevational side view of a separating system for separating electroconductive and non-electroconductive materials using the ECS of FIG. 1, in accordance with certain exemplary embodiments.
Figure 5:
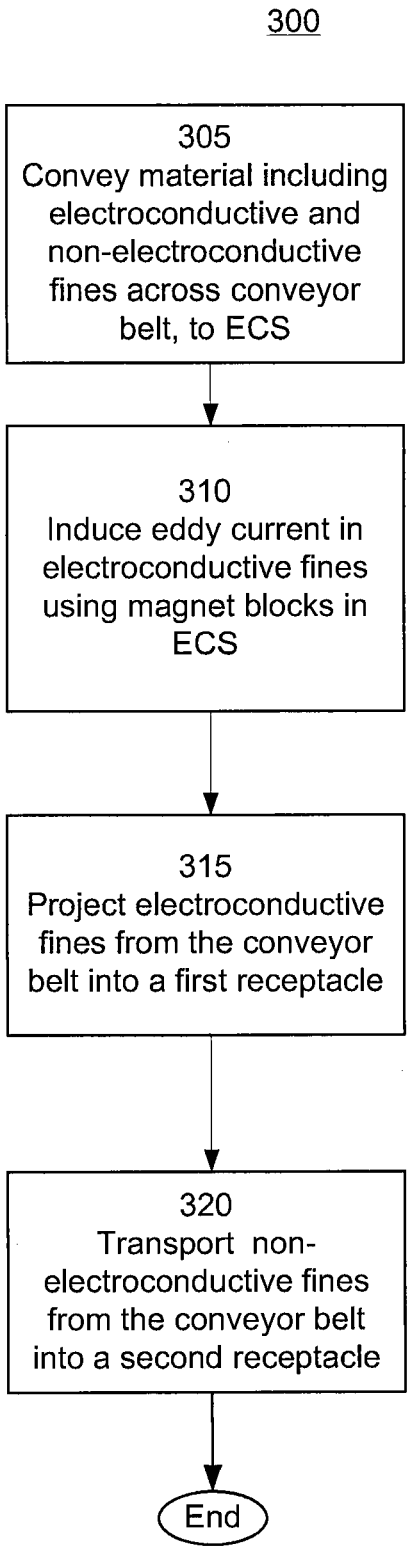
FIG. 5 is a flow chart depicting a method for separating electroconductive and non-electroconductive materials using the system of FIG. 4, in accordance with certain exemplary embodiments.

FIG. 4 depicts a separating system 200 for separating electroconductive and non-electroconductive materials, in accordance with certain exemplary embodiments. FIG. 5 is a flow chart depicting a method 300 for separating electroconductive and non-electroconductive materials using the system of FIG. 4, in accordance with certain exemplary embodiments. The exemplary method 300 is illustrative and, in alternative embodiments of the invention, certain steps can be performed in a different order, in parallel with one another, or omitted entirely, and/or certain additional steps can be performed without departing from the scope and spirit of the invention. The method 300 is described hereinafter with reference to FIGS. 4-5.

In step 305, material 205 is conveyed across a conveyor belt 210. The material 205 includes a variety of electroconductive and non-electroconductive materials that will be separated by an ECS 100 associated with the conveyor belt 210, as described below. For example, in certain exemplary embodiments, the material 205 can include waste or scrap materials that may or may not have already been processed in accordance with a primary recycle and recovery effort. For example, the waste material may include materials left-over from prior processing of ASR, WSR, WEEE, and/or municipal waste (incinerated or not). The method 300 may be used to recover (or further recover) materials from the waste stream, thereby reducing the amount of waste materials left in a landfill or other location. In certain alternative exemplary embodiments, the material 205 can be transported and received by any of a variety of mechanisms other than a conveyor belt 210, including, without limitation, one or more slides, chutes, screw conveyors, augers, and the like.

The conveyor belt 210 conveys the material 205 to the ECS 100 associated with the conveyor belt 210. For example, the conveyor belt 210 may move around or over the ECS 100 in certain exemplary embodiments. As described above with reference to FIGS. 1-3, the ECS 100 includes an assembly that rotates magnet blocks to generate an eddy current. In step 310, the eddy current is induced in electroconductive materials 220 in the material 205. The eddy current produces a magnetic field that has a polarity that is the same as the polarity of the magnet(s) that induced the eddy current.

Since like magnetic poles repel on another, the material 220 in which the eddy current is created is repelled and projected away from the conveyor belt 210, along a predictable trajectory, in step 315. The material 220 is projected to, and collected in, a first receptacle 225. The non-electroconductive material 230 falls from the end of the conveyor belt 210 into a second receptacle 235 in step 320. Thus, the ECS 100 separates the electroconductive materials 220 and non-electroconductive materials 230 into the first and second receptacles 225 and 235, respectively.

The system 200 and method 300 can be used to separate electroconductive materials 220 and non-electroconductive materials 230 of various shapes and sizes. In certain exemplary embodiments, the system 200 includes a screen (not shown) or other device that segregates the material 205 according to size prior to conveying the material 205 to the ECS 100 for separation. The system 200 can include different ECS 100 devices for different-sized materials 205. For example, different ECS 100 devices can separately process materials having diameters less than 10 millimeters (fines), materials having diameters between 10 millimeters and 0.75 inches, materials having diameters between 0.75 inches and 1.5 inches, and materials having diameters greater than 1.5 inches.

As described above, the ECS 100 is operable to separate fines effectively and durably at high frequencies, such as frequencies greater than 4,000 rotations per minute for an ECS 100 up to one meter wide and 3,000 rotations per minute for an ECS 100 up to 1.5 meters wide. The "width" of the ECS 100 is the length of the rotating assembly of the ECS 100, which substantially equals the width of the conveyor belt 210.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A method for separating electroconductive materials from nonelectroconductive materials, the method comprising:

conveying a material to a separator, the material including the electroconductive materials and the nonelectroconductive materials;

generating an eddy current at the separator using a motor coupled to a magnetic support tube, the magnetic support having a plurality of magnets coupled thereto and having a length of about 1.5 meters;

operating the motor at a frequency of at least about 4,000 rotations per minute inducing the eddy current in the electroconductive materials to transport the electroconductive materials away from the separator;

collecting the electroconductive materials in a first receptacle; and collecting the nonelectroconductive materials in a second receptacle.

2. The method of claim 1, further comprising:

separating the material according to size before conveying the material to the separator.

3. The method of claim 1, further comprising:

operating the motor at a frequency of at least about 6,000 rotations per minute;

wherein the magnetic support tube has a length of about one meter.

4. The method of claim 1, further comprising:

operating the motor at a frequency of at least about 3,000 rotations per minute, and wherein the magnetic support tube has a length of at least about 2.5 meters.

5. The method of claim 4, wherein the magnetic support tube has a length of at least about 3 meters.

6. The method of claim 1, wherein each of the electroconductive materials have a diameter less than about 10 millimeters.

7. A system for separating electroconductive materials from nonelectroconductive materials, comprising:

a conveyor for providing a material to a separator, the material including the electroconductive materials and the nonelectroconductive materials; and the separator including:

a magnet support tube having a plurality of magnets coupled thereto;

a jacket tube housing the plurality of magnets, the jacket tube operable to contain the centrifugal forces of the plurality of magnets during rotation;

a first hub coupled to a first end of the magnet support tube;

a second hub coupled to a second end of the magnet support tube; and a motor coupled to at least one of the first hub and the second hub, the motor rotating the magnet support tube and the plurality of magnets to generate an eddy current in the electroconductive materials conveyed proximate the separator and transport the electroconductive materials away from the separator.

8. The system of claim 7, wherein the jacket tube has a negative allowance.

9. The system of claim 7, wherein the jacket tube comprises a titanium alloy.

10. The system of claim 7, further comprising:

a screen for segregating the material according to size.

11. The system of claim 7, wherein the magnet support tube has a natural frequency of about 28,000 rotations per minute.

12. The system of claim 7, wherein the plurality of magnets are arranged in a series of axial rows around the magnetic support tube.

13. The system of claim 7, wherein each of the plurality of magnets in a same axial row have a same polar orientation and each of the plurality of magnets in an adjacent axial row have an opposite polar orientation.

14. The system of claim 7, wherein the motor operates at a frequency of at least about 6,000 rotations per minute; and wherein the magnetic support tube has a length of about one meter.

15. The system of claim 7, wherein the motor operates at a frequency of at least about 4,000 rotations per minute, and wherein the magnetic support tube has a length of about 1.5 meters.

16. The system of claim 7, wherein the motor operates at a frequency of at least about 3,000 rotations per minute, and wherein the magnetic support tube has a length of at least about 2.5 meters.

17. The system of claim 7, wherein the electroconductive materials have a diameter less than about 10 millimeters.

18. The system of claim 7, further comprising:

a first receptacle for collecting the electroconductive materials, and a second receptacle for collecting the nonelectroconductive materials.

19. A method for separating electroconductive materials from nonelectroconductive materials, the method comprising:

conveying a material to a separator, the material including the electroconductive materials and the nonelectroconductive materials;

generating an eddy current at the separator using a motor coupled to a magnetic support tube, the magnetic support having a plurality of magnets coupled thereto and having a length of about 2.5 meters;

operating the motor at a frequency of at least about 3,000 rotations per minute inducing the eddy current in the electroconductive materials to transport the electroconductive materials away from the separator;

collecting the electroconductive materials in a first receptacle; and collecting the nonelectroconductive materials in a second receptacle.

20. The method of claim 19, wherein the magnetic support tube has a length of at least about 3 meters.

* * * * *